US005751300A

United States Patent [19]

Cowger et al.

[11] Patent Number: 5,751,300

[45] Date of Patent: May 12, 1998

[54] INK DELIVERY SYSTEM FOR A PRINTER

[75] Inventors: Bruce Cowger; Ronald W. Hall, both of Corvallis, Oreg.; Paul D. Gast, Vancouver; Alan Shibata, Camas, both of Wash.

[73] Assignee: Hewlett-Packard Company, Palo Alto, Calif.

[21] Appl. No.: 192,085

[22] Filed: Feb. 4, 1994

[51] Int. Cl.[6] ..... B41J 29/38; B41J 23/00; B41J 2/175; B41J 2/18

[52] U.S. Cl. ..... 347/6; 347/37; 347/85; 347/89

[58] Field of Search ..... 347/85, 86, 87, 347/37, 94, 6, 89, 92, 93

[56] References Cited

U.S. PATENT DOCUMENTS

| | | | |
|---|---|---|---|
| 3,296,624 | 1/1967 | Ascoli . | |
| 3,787,884 | 1/1974 | Demer . | |
| 4,050,564 | 9/1977 | Carmichael et al. | 347/37 X |
| 4,074,284 | 2/1978 | Dexter et al. | 347/86 X |
| 4,246,589 | 1/1981 | Denny et al. . | |
| 4,323,907 | 4/1982 | Italiano . | |
| 4,342,041 | 7/1982 | Kasugayama et al. . | |
| 4,347,524 | 8/1982 | Engel et al. . | |
| 4,383,263 | 5/1983 | Ozawa et al. . | |
| 4,394,669 | 7/1983 | Ozawa et al. . | |
| 4,422,084 | 12/1983 | Saito . | |
| 4,422,086 | 12/1983 | Miura et al. . | |
| 4,429,320 | 1/1984 | Hattori et al. . | |
| 4,433,341 | 2/1984 | Thomas . | |
| 4,462,037 | 7/1984 | Bangs et al. . | |
| 4,463,362 | 7/1984 | Thomas . | |
| 4,471,364 | 9/1984 | Kocot . | |
| 4,475,116 | 10/1984 | Sicking et al. . | |
| 4,496,959 | 1/1985 | Frerichs . | |
| 4,518,973 | 5/1985 | Tazaki . | |
| 4,527,175 | 7/1985 | Kojima et al. . | |
| 4,558,326 | 12/1985 | Kimura et al. | 347/35 X |
| 4,630,758 | 12/1986 | Mutoh . | |
| 4,636,814 | 1/1987 | Terasawa | 347/7 X |
| 4,680,696 | 7/1987 | Ebinuma et al. | 347/85 |
| 4,719,479 | 1/1988 | Kyogoku . | |
| 4,827,282 | 5/1989 | Ritchie . | |
| 4,831,389 | 5/1989 | Chan . | |
| 4,849,773 | 7/1989 | Owatari . | |
| 4,914,522 | 4/1990 | Duffield et al. . | |
| 4,928,126 | 5/1990 | Asai . | |
| 4,937,598 | 6/1990 | Hine et al. . | |
| 4,999,651 | 3/1991 | Duffield et al. . | |
| 5,030,973 | 7/1991 | Nonoyama et al. . | |
| 5,159,348 | 10/1992 | Dietl et al. | 347/89 |
| 5,189,436 | 2/1993 | Yoshikawa | 347/37 |
| 5,189,438 | 2/1993 | Hine et al. . | |
| 5,216,450 | 6/1993 | Koitabashi et al. | 347/87 |
| 5,258,773 | 11/1993 | Arakawa et al. | 347/37 |
| 5,351,073 | 9/1994 | Kageyama et al. | 347/94 |

*Primary Examiner*—David F. Yockey

[57] ABSTRACT

In a method and system for delivering ink within a printer, a reservoir and a portion of a tube are accelerated so as to generate an inertial flow of ink in the tube, where the tube is connected to the reservoir and in fluid communication with an ink supply. A valve is provided between the tube and the reservoir. The valve is closed to retain an amount of the inertial flow of ink in the reservoir when the inertial flow of ink is away from the reservoir. The tube is primed by moving the printer so as to elevate the ink supply relative to the reservoir in the printer. Foam may be provided within the reservoir which restricts the rate of flow by not allowing ink to be conducted from the reservoir when the foam is unsaturated.

13 Claims, 3 Drawing Sheets

INK DELIVERY SYSTEM FOR A PRINTER

TECHNICAL FIELD

The present invention is directed to a system for delivering ink from a stationary supply container to a pen that is carried in the reciprocating carriage of an ink-jet type printer.

BACKGROUND INFORMATION

One type of ink-jet printer includes a carriage that is reciprocated back and forth across a sheet of paper that is advanced through the printer. The reciprocating carriage holds a pen very close to the paper. The pen is controlled by the printer for selectively ejecting ink drops from the pen while the pen is reciprocated or scanned across the paper, thereby to produce characters or an image on the paper.

The pen has a reservoir for holding a limited amount of ink. A relatively larger supply of ink is provided in a stationary container that is mounted to the printer. A tube is connected between the supply container and the pen, thereby to conduct the flow of ink from the supply container to the pen for replenishing the pen reservoir as needed.

An important design consideration for ink-jet printers is to maximize the printing speed. One method of increasing the speed of the printing operation is to increase the velocity with which the pen is scanned across the paper. Reducing the weight of the pen, including the reservoir, permits high velocity scanning of the pen while minimizing the power requirements of the motor that drives the carriage.

Increased printing speeds require a corresponding increase in the flow rate with which ink is supplied to the pen. Gravitational or capillary forces for conducting ink through the tube from the supply container to the pen reservoir are insufficient when such high-speed, high-flow rate ink-jet pens are employed.

SUMMARY OF THE INVENTION

The present invention is directed to a system that provides an efficient technique for delivering ink from a supply container through a tube to the reservoir of a pen that is carried in the reciprocating carriage of a printer.

The invention generally provides a system for controlling the inertial flow of ink that occurs in the pen supply tube as a result of acceleration of the pen by the reciprocating carriage.

DESCRIPTION OF PREFERRED EMBODIMENTS

Figure 1:
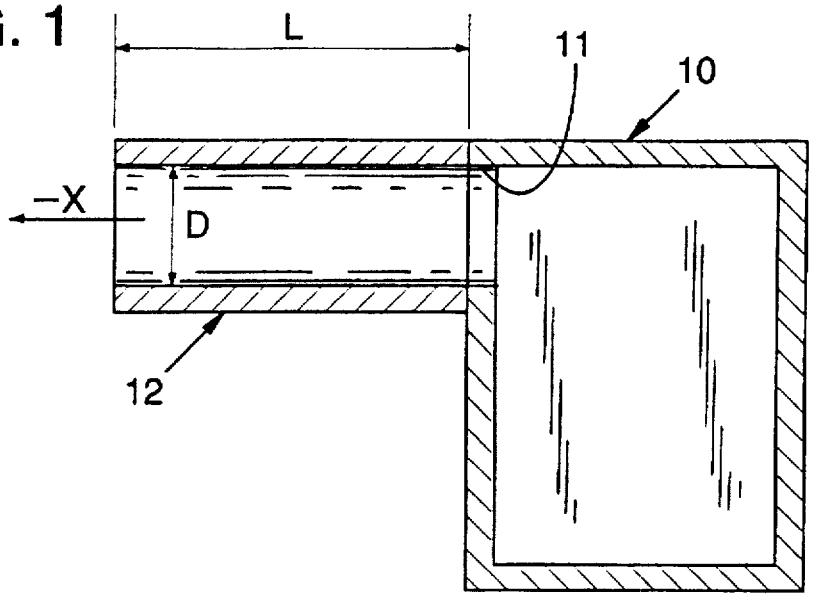
FIG. 1 is a diagram for the purpose of illustrating the principles employed in the inertial flow-control aspect of the present invention.

The diagram of FIG. 1 is useful for illustrating the general principles underlying the ink delivery system of the present invention. That diagram shows an ink-jet pen reservoir 10 that is to be replenished with ink. The ink is conducted through an opening 11 in the reservoir, into the interior of the reservoir 10 through a supply tube 12. A segment of the tube having a unit length L is shown connected to the reservoir 10 with the interior of the tube in fluid communication with the interior of the reservoir.

The reservoir opening 11 is located so that unless the tube 12 is occluded near the reservoir, the ink within the tube will flow into the reservoir whenever the reservoir and connected segment of the tube are accelerated in the −x direction as shown by the arrow in FIG. 1. Such acceleration occurs when the reservoir and connected tube segment of an ink-jet pen are driven to reverse directions (from the +x to the −x direction) following one scan across the paper.

The ink flow attributable to the acceleration of the pen and tube segment is characterized as inertial flow inasmuch as such flow is considered from a noninertial frame of reference; namely, the accelerated pen and connected tube segment. The amount of inertial ink flow through tube segment 12 can be quantified by considering as a free body the fluid element contained within circular tube segment 12 and applying the equation of motion. Put another way, the inertial pumping pressure $P_i$ applied to the fluid element can be considered as reaction to the flow resistance that, in terms of the Hagen-Poiseuille equation, can be expressed as $$P_i = \frac{128\mu LQ}{\pi D^4} \quad [1]$$

where μis the viscosity of the fluid; Q is the flow rate; L is the tube length; and D is the inside diameter of the tube.

For an acceleration a of a tube segment having circular cross-sectional area $A=(\pi D^2)/4$ containing ink of a density ρ, $Q_p$ represents the peak inertial flow rate which, from equation 1, can be written as:

$$Q_p = \frac{\pi a \rho D^4}{128\mu} \quad [2]$$

At the end of each scan of the pen, the pen direction (hence, its velocity) is reversed and the acceleration of the pen changes from zero to a during the acceleration time $t_a$. The acceleration of the fluid element is:

$$a = \frac{dV}{dt} = \frac{1}{A}\ \frac{dQ}{dt} \quad [3]$$

The volume of flow $V_1$ during the time $t_a$ that the element is accelerated is determined as:

$$V_1 = \int_0^{t_a} Q dt = Q_p \int_0^{t_a} 1 - e^{-ct} dt = Q_p \left[ t_a + \frac{e^{-ct} - 1}{c} \right] \quad [4]$$

where c is a constant equal to $32\mu/(\rho D^2)$.

Figure 2:
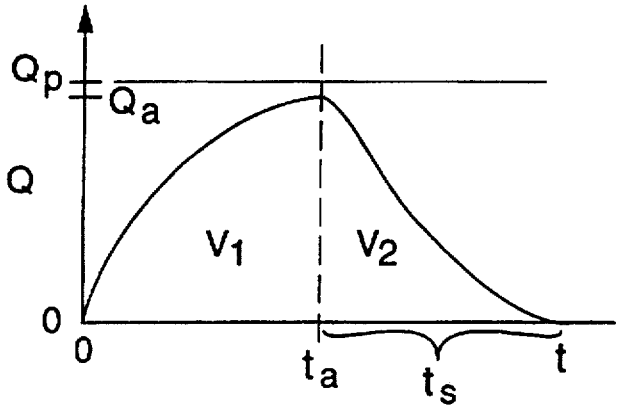
FIG. 2 is a graph depicting inertial flow rate versus time for an element of supply ink.

The inertial flow volume component $V_1$ attributable to the acceleration of the pen is depicted in the graph of FIG. 2. Following the completion of the acceleration time period $t_a$, the inertial flow of ink through the tube will gradually diminish throughout the time period $t_s$ that the tube continues to move in the direction it was just accelerated (that is, as the pen is scanned across the page).

This second inertial flow volume component $V_2$ of the ink is also depicted in FIG. 2 and can be quantified as:

$$V_2 = Q_a \int_0^{t_s} e^{-ct} dt = \frac{Q_a}{c} [1 - e^{-ct}] \quad [5]$$

where $Q_a$ is the flow rate occurring at the end of acceleration time $t_a$.

Employing the above equations for an ink supply tube segment having a circular inside diameter D of 0.1 in, ink having a specific gravity of 1.04 and viscosity of $4.4\times10^{-7}$ (lbf-sec)/in$^2$, the tube being accelerated at twice the acceleration of gravity (i.e., 2 g) for reversing the direction of a pen traveling at 20 in/sec (hence, acceleration time $t_a$=0.05 sec), the total volume $V_i$ of inertial flow of ink $V_1+V_2$ into the reservoir as a result of the acceleration and subsequent scanning of the pen across an 8 inch page at a velocity of 20 in/sec (that is, $t_s$=0.4 sec), would be approximately 0.34 ml.

Any number of mechanisms may be employed for regulating the inertial ink flow between a supply tube and a pen reservoir that is carried on a reciprocating carriage. One such embodiment is depicted in the diagrams of FIGS. 3 and 4, and described next.

Figure 3:
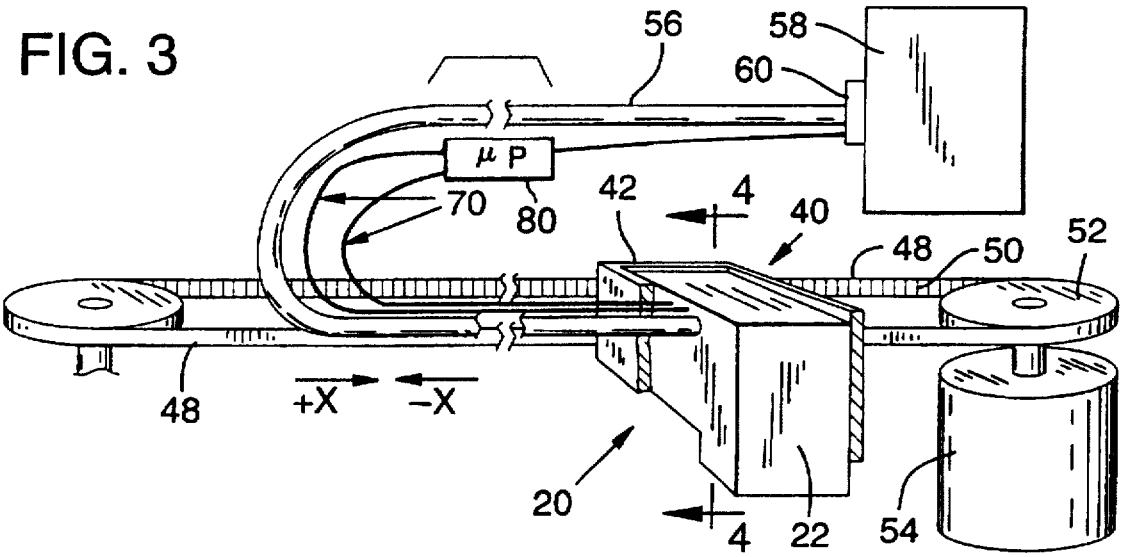
FIG. 3 is a diagram showing one embodiment of the ink delivery system of the present invention.
Figure 4:
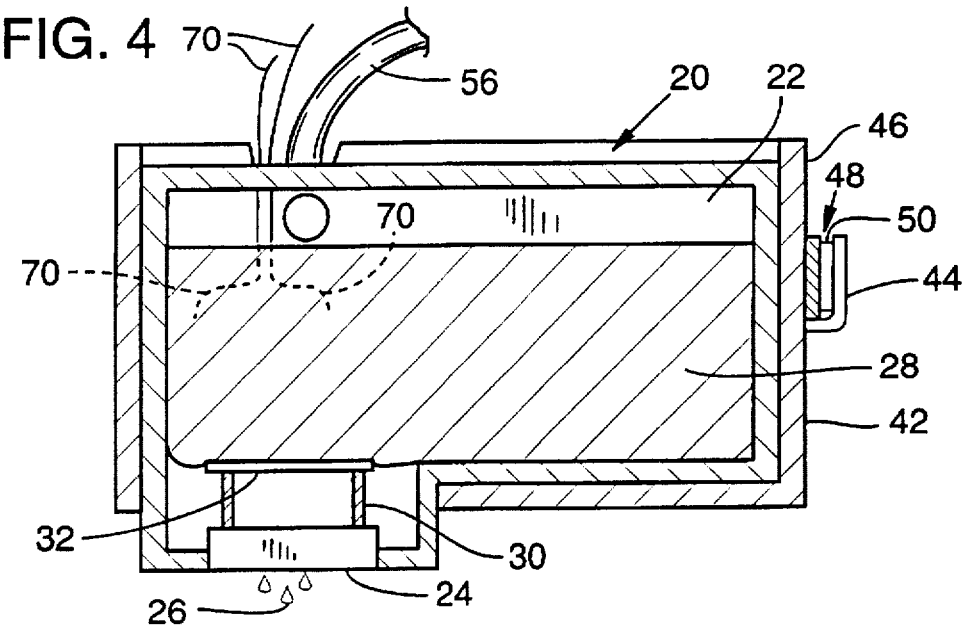
FIG. 4 is a cross sectional diagram, taken along line 4—4 of FIG. 3.

In the embodiment of FIGS. 3 and 4, an ink-jet pen 20 is scanned back and forth across a page of paper that is advanced through a printer. The pen scan direction designated −x represents the movement of the pen from right to left, the +x direction represents the movement of the pen from left to right. The pen can be any one of a number of designs generally comprising a reservoir 22 that holds a relatively small volume of ink in fluid communication with a print head 24 (FIG. 4) that is carried on the underside of the pen.

The print head 24 may be a thermal-type that employs a plurality of thin-film resistors, each resistor being located along a channel of ink and adjacent to a nozzle formed in the print head. The resistors are selectively fired (heated) for expanding a small volume of ink that is adjacent to the resistor. The ink expansion forces a drop of ink 26 (shown greatly enlarged) through the nozzle.

The suction that is generated as ink drops are ejected through the print head draws ink from the reservoir 22 through the channels to the print head to replace the ink just ejected. Electrically conductive leads, generally comprising minute copper traces, extend from the resistors and are grouped on a flexible circuit (not shown) that is bonded to the exterior of the pen. The circuit is placed in electrical communication with the printer microprocessor by known means (such as a ribbontype multiconductor). The microprocessor controls the operation of the print head.

In one preferred embodiment, the interior of the pen reservoir 22 is substantially filled with a foam 28 such as reticulated polyether urethane with high ethylene oxide, as available from FOAMEX Inc., Eddystone, Pa., having a density of 1.3 to 1.5 lb/cu ft., and 70 pores/inch, without felting. The ink is stored within the pores of the foam. The foam 28 has sufficient capillarity to prevent the ink from leaking through the print head, but the capillarity is overcome by the suction developed in the print head as ink is ejected. The capillarity of the foam, therefore, establishes a back pressure at the print head for restricting ink flow through the print head in the absence of print head operation.

It is contemplated that other reservoir configurations, such as a collapsible bladder, could be used for retaining the ink in fluid communication with the print head and with sufficient back pressure to prevent leakage.

In a preferred embodiment (FIG. 4) a tubular standpipe 30 extends between the foam 28 and the print head 24. At the junction of the standpipe 30 and the foam 28 the standpipe is covered with a fine-mesh screen 32 that serves to prevent air bubbles from entering the standpipe 30 and to filter particles from the ink in the reservoir as the ink passes through the screen to the print head.

One mechanism for scanning the ink-jet pen 20 back and forth across a page of paper may be a carriage assembly 40 as shown somewhat schematically in FIGS. 3 and 4. The assembly includes a carriage frame 42 that generally conforms to the shape of the pen 20. The pen is removably mounted to the carriage in an orientation such that the print head 24 faces the paper. The carriage frame includes a protruding drive bracket 44 (FIG. 4). Between the bracket 44 and the frame wall 46 from which the bracket protrudes fits an endless, toothed drive belt 48. The teeth 50 of the drive belt mesh with inwardly protruding teeth on the drive bracket 44 thereby fixing the position of the belt 48 relative to the frame 42. The drive belt 48 engages a pulley 52 on the shaft of a reversible, variable-speed DC motor 54 of conventional design.

While the carriage assembly 40 depicted in FIGS. 3 and 4 will suffice for scanning the pen in opposing directions, it is contemplated that any of a number of mechanisms may be employed for reciprocating the pen.

As noted, the reservoir 22 of the pen carries a limited supply of ink that is replenished from time to time by the inertial flow of ink through a supply tube 56 that extends between the pen reservoir 22 and a remote container 58 that holds a relatively large volume of ink.

In one preferred embodiment, the container 58 is a collapsible member that is connected to the tube 56 in a manner that permits replacement of an empty container with a full one. The container may be manually or mechanically compressed to initially fill or prime the tube 56 with ink.

Preferably, the supply tube 56 is constructed of material, such as polyvinylidene chloride, to be somewhat flexible. The tube is supported within the printer so that at least some of its ink-filled length (L in FIG. 1) is located in the path of movement (+x and −x) of the reservoir (the "active" length of the tube) so that inertial flow of ink will occur as described more fully below.

Valving is employed for regulating the inertial flow of ink through the tube 56. In one embodiment, valve 60 (FIG. 3) may be any small electronically operated valve, such as from Predyne, New Britain, Conn., model A3113-S4, for selectively opening and occluding the fluid communication between the interior of the supply tube 56 and reservoir 22. The valve 60 is connected to the printer microprocessor 80, which controls the opening and closing of the valve at intervals as explained more fully below. In a preferred embodiment, the valve is mounted adjacent to the ink container 58. Alternatively, the valve may be mounted at the junction of the tube 56 and pen reservoir 22.

As the reservoir 22 of the ink-jet pen is depleted of ink during the printing operation, a replenishing volume of ink is conducted from the ink supply container 58 through the tube 56 and into the reservoir 22 of the pen. To this end, valve 60 is opened by a suitable signal from the microprocessor 80. As the pen within the carriage is accelerated for reversing its direction from the +x to the −x direction, and as the scan in the −x direction continues with the valve open, a predictable volume of ink (see equations 1–5 above) will flow into the reservoir. It will be appreciated that for a given reservoir volume several combinations of variables, such as the supply tube diameter and acceleration, could be selected to provide an inertial-flow volume $V_i$ that is sufficient for rapidly replenishing the reservoir without overfilling the reservoir.

A transducer may be employed for monitoring the amount of ink in the reservoir 22 at any time to avoid overfilling of the pen reservoir. For example, as shown in FIG. 4, a transducer can include two spaced-apart conductive leads 70 embedded within the foam 28 of the pen reservoir. A low voltage is applied across the leads and the resulting current is monitored by the microprocessor 80 for the purpose of detecting an increase in the transducer output that would occur as replenishing ink moves between the two leads 70.

In instances where the pen changes from −x to +x scan and the pen and tube 56 are oriented so there is still significant active length, the valve 60 is closed just before the pen is accelerated to change its direction from the −x to the +x direction and remains closed until just before the direction of the pen is changed from the +x to the −x direction. Closing the valve during the +x scan prevents ink that moved into the pen in the prior right-to-left scan from flowing back out of the pen in the left-to-right scan.

As an alternative to closing the valve 60 each time the pen is scanned to the right, the valve 60 can be supplemented with a simple flap or check valve that normally closes to prevent inertial ink flow in the direction from the pen into the tube. Such valving of the tube reduces the number of times the valve 60 must be opened and closed.

Figure 5:
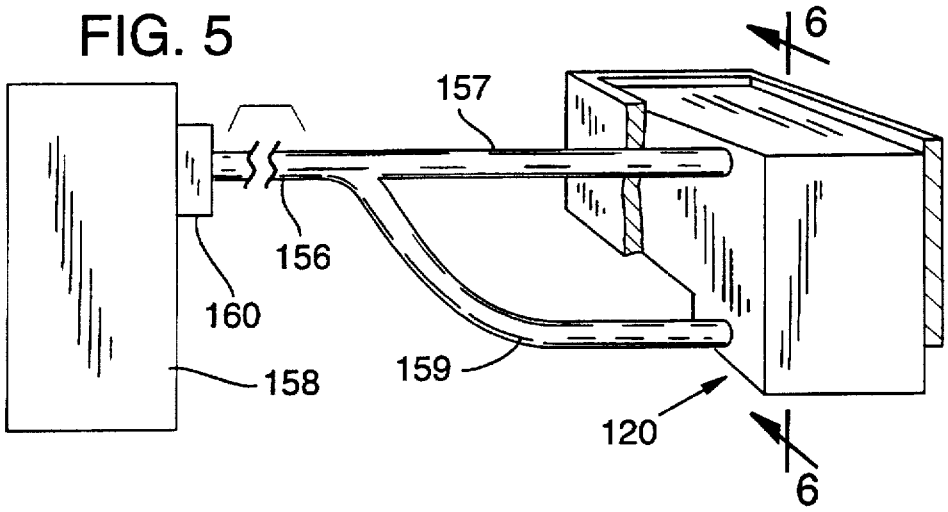
FIG. 5 is a diagram of an alternative mechanism for regulating inertial ink flow into the pen and for permitting excess ink to flow out of the pen.
Figure 6:
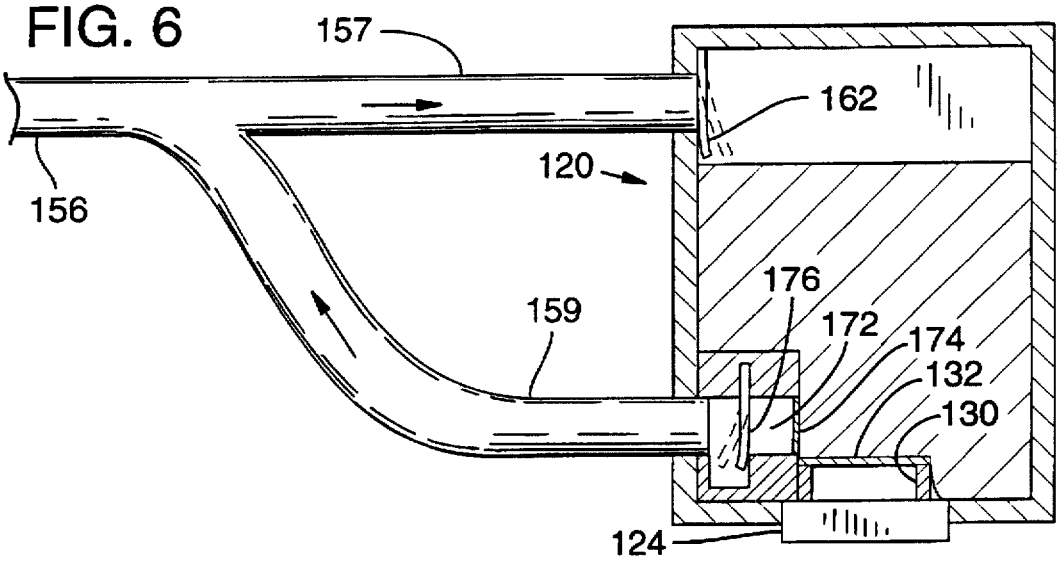
FIG. 6 is a cross sectional diagram taken along line 6—6 of FIG. 5.

An alternative embodiment depicted in FIGS. 5 and 6 eliminates the need for a transducer or other indicator of a full reservoir and instead employs a mechanism for instantaneously removing from the pen excess ink, should the reservoir be overfilled. This embodiment is especially adaptable for use with pens that include foam for back pressure regulation as mentioned earlier.

The embodiment of FIGS. 5 and 6 permits less precise monitoring of the amount of ink in the pen reservoir since an overfill amount will be quickly removed from the pen. The amount of ink depleted from the pen reservoir during printing can be simply monitored by the microprocessor, which can save in memory information, denoted "drop counts", that is indicative of the number of times the print head resistors are fired, which correlates directly to the approximate amount of ink ejected from the pen.

In particular, one end of the supply tube 156 is formed to have two branches, an inlet branch 157 and an outlet branch 159. The other end of supply tube 156 is connected to the ink supply container 158. At the junction of the supply tube 156 and container 158 there is provided an electronic valve 160 substantially similar to valve 60 provided in the above-described embodiment.

Whenever the microprocessor drop count indicates that the pen reservoir should be refilled, the valve 160 is opened so that acceleration of the pen in the −x direction causes inertial ink flow into the pen via inlet branch 157. Hereafter, the acceleration and subsequent scanning of the pen that directs inertial flow of ink toward the reservoir will be referred to as an inflow scan, and the resulting flow designated inertial inflow.

The terminus of the inflow branch 157 is fitted with a flap or check valve 162 that is oriented to prevent ink flow out of the reservoir 22 through the inflow branch.

It is noteworthy here that for foam of the type described above, the back pressure established as a result of the capillarity of the foam will generally be in the range of about −4 inches (water column) as long as the foam remains unsaturated with ink. When the foam is oversaturated, it will acquire a slight positive pressure. The provision of the outlet branch 159 permits the rapid removal of any excess ink that flows into the pen reservoir to oversaturate the foam during an inflow scan.

Specifically, the outlet branch 159 of the supply tube 156 provides a path for removal of excess ink from the pen reservoir. The excess ink is that present when the foam is oversaturated. Preferably, the outlet branch 159 terminates near the print head 124 immediately adjacent a collection volume or sump 172. A screen 174 screens ink that flows into the sump 172. The terminus of the outlet branch 159 also includes a flap or check valve 176 that permits inertial flow through that branch only out of the pen as the pen is accelerated and scanned in the +x direction. Hereafter, the acceleration and subsequent scanning of the pen that directs inertial flow of ink away from the reservoir will be referred to as an outflow scan, and the resulting flow designated inertial outflow.

In the event that flow through the inlet branch overfills the reservoir, the foam will become oversaturated and its back pressure will diminish to zero or become slightly positive. During the immediately following outflow scan, the excess amount of ink flows through the outlet branch 159, and back pressure within the foam is quickly re-established.

It is contemplated that the terminus of the outflow branch 159 could directly abut the screen 174, thereby eliminating the need for a sump. Further, the terminus of the outflow branch 159 could intersect the standpipe 130 (without employing a screen 174), thereby tending to advantageously remove via the outflow branch air that becomes trapped beneath the screen 132.

Figure 7:
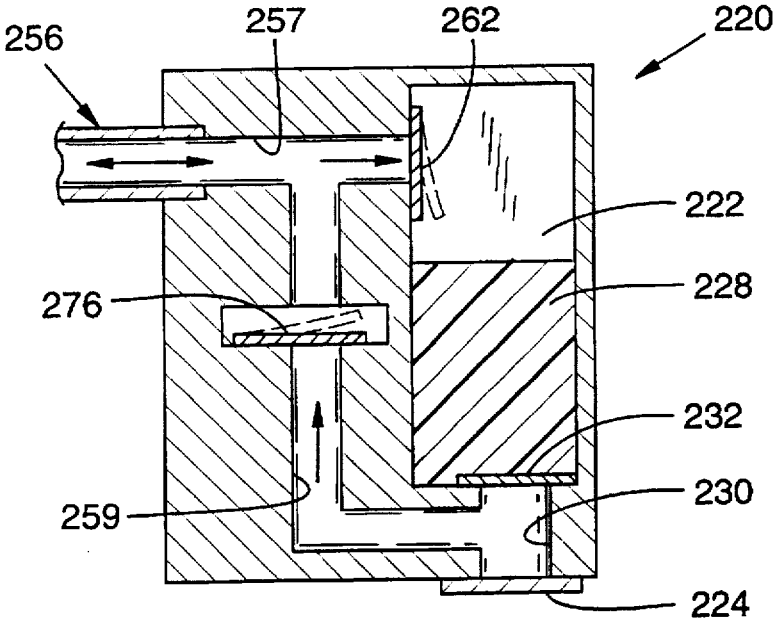
FIG. 7 is a diagram of an alternative embodiment of a pen that may be employed with the present system.

The pen 220 depicted in FIG. 7 may be used as an alternative to that shown in FIGS. 5 and 6. In this embodiment, the single supply tube 256 connects with the pen. The pen body defines an internal inlet branch 257 and outlet branch 259, the function of which branches substantially corresponds to the branches 157, 159 explained above. The terminus of the inflow branch 257 is above the ink-retaining foam 228 and is fitted with a flap or check valve 262 that is oriented to prevent ink flow out of the reservoir 222 through the inflow branch 257.

The outlet branch 259 provides a path for removal of the excess ink from the pen reservoir that occurs when the foam is oversaturated. The outlet branch 259 intersects the stand pipe 230 that extends between the printhead 224 and the screen 232 that is located between the foam 228 and the stand pipe 230.

Between the location where the inlet branch 257 and outlet branch 259 join, a flap or check valve 276 is incorporated into the pen body to permit inertial flow through the outlet branch 259 out of the pen 220 (via supply tube 256) as the pen is accelerated and scanned in the +x direction.

The branches 257 and 259, and the portion of the pen body that defines them, are shown greatly enlarged for illustrative purposes in FIG. 7. It will be appreciated by one of ordinary skill that the passages may be constructed very near the foam 228 to minimize the size of pen body required to define the branches, so that a very high percentage of the overall volume of the pen will be used for carrying the ink-filled foam 228.

As another aspect of the just described embodiments, the printer carriage motion is controlled so that the acceleration for generating inertial inflow is different than the acceleration for generating inertial outflow so that in an overfill condition (that is, where the inertial inflow oversaturates the foam) slightly more ink will flow out of the pen than into the pen. Moreover, the reciprocal motion employed during the replenishing process is controlled so that the pressure developed in generating inertial outflow will not exceed the back pressure or capillarity of the foam, thereby preventing inertial outflow when the foam is in an unsaturated condition.

In connection with the aspect of ensuring that the pressure developed for generating inertial outflow does not exceed the unsaturated-foam back pressure, it is pointed out that it will generally be desirable to employ as low an acceleration as practical for the reciprocating the carriage, thereby to minimize wear and load demands on the carriage drive motor. For a given velocity change $\Delta V$ (for example, 40 in/sec, corresponding to the complete reversal of a 20 in/sec carriage velocity) the acceleration time $t_a$ increases with decreasing acceleration, inasmuch as $t_a=\Delta V/a$. The increase in acceleration time has a corresponding increase in the inertial flow volume so that reducing the pen acceleration also has the effect of increasing the inertial flow. When considering the inertial outflow, it is important to ensure that the corresponding acceleration is not of such a magnitude that the unsaturated-foam back pressure is overcome by the pressure of the inertial outflow. In this regard, the appropriate equation is:

$$\rho(AL_a)a=P_{bp}A \quad [6]$$

where $P_{bp}$ is the back pressure in unsaturated foam (for example, −4 in; $L_a$ is the accelerated or active length of the tube through which inertial flow of ink occurs; and other variables are as defined earlier. Rewriting equation 6 in terms of active length $L_a$ yields:

$$L_a=\frac{P_{bp}}{a\rho} \quad [7]$$

In accordance with the present invention, for a given acceleration a the appropriate active length $L_a$ of the supply tube is determined by the equation 7 above. Therefore, for a foam back pressure of −4 in, acceleration of 2 g and an ink specific gravity of 1.04, the appropriate active length $L_a$ will be 1.92 inches. This means that the length of tube accelerated for generating inertial outflow should be restricted to 1.92 in or less. The length across which the pen and carriage are normally reciprocated during the printing operation is significantly greater, about 8 in.

Implementing the active length restriction during the refill process is carried out by moving the carriage to a location where only the active length of the tube will be significantly moved during the process. For example, moving the carriage 40 toward the left in FIG. 3 will shorten the active length of the tube 55. Once the carriage is located in the region where the active length of the tube is sufficiently shortened, the valve 160 is opened and the carriage reciprocated back and forth across a distance that results in only the active length La of the tube being accelerated. Restricting the active length of the tube may also be desirable during replenishing of the reservoir of the embodiment shown in FIGS. 3 and 4.

As noted earlier, it is also desirable to accelerate the pen 120 of the embodiment of FIGS. 5 and 6 or during the replenishing or refilling operation with an inflow acceleration that is different than the outflow acceleration so that slightly more ink will be pumped from the pen when the pen foam becomes oversaturated (such as may occur near the completion of the refilling process). The use of a relatively short active length of tube (for example, 1.92 in, as mentioned above) means that essentially no scan time $t^s$ exists between the velocity-reversing accelerations (as would otherwise occur when the entire page width were traversed during the refill process) hence, very little of the inertial flow component $V_2$ (equation 5) will be present. Nearly the entire inertial flow volume, therefore, will be attributable to that volume $V_1$ that occurs during the acceleration period $t_a$.

In this regard, it is noteworthy that for high accelerations the acceleration period $t_a$ diminishes, hence, the flow volume $V_i$ also diminishes. Accordingly, the acceleration applied to generate inertial inflow (for example, 1.0 g) is made larger than the acceleration applied to cause inertial outflow (for example, 0.25 g).

Figure 8:
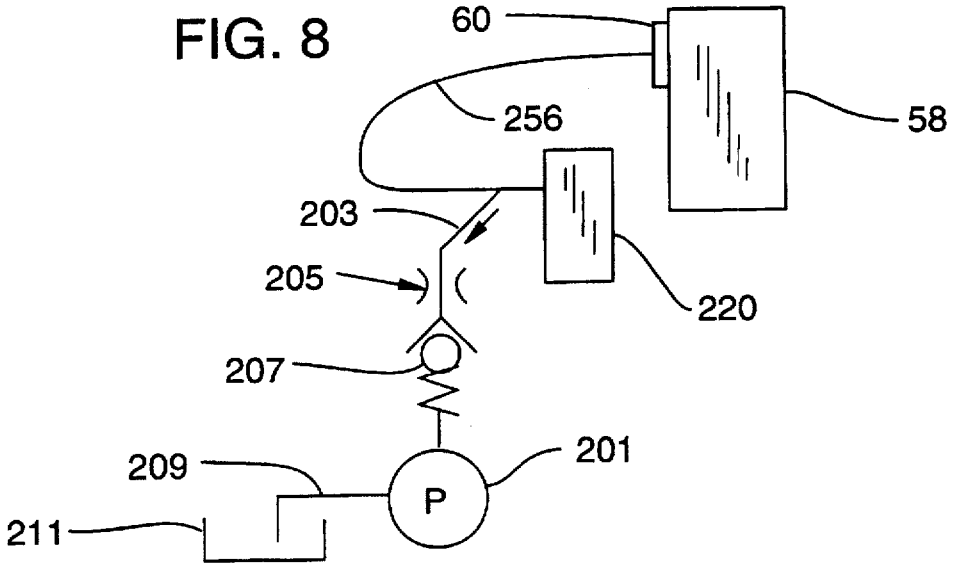
FIG. 8 is a diagram of a preferred assembly for priming the ink supply tube of the pen.

As mentioned earlier, the ink supply container 58 may be manually or mechanically compressed to initially fill or prime the supply tube 56 with ink. FIG. 8 is a diagram of another preferred method for priming the supply tube. The priming assembly is shown in FIG. 8 as adapted to the components of the embodiment of FIG. 7, but it will be understood that the same priming assembly may be incorporated to prime the ink supply tube of any embodiment.

The priming is generally carried out by a pump 201 of the positive-displacement type. The pump draws ink through a return line 203 that joins the supply tube 256 very near the reservoir 220. The flow in the return line 203 passes through a flow restrictor 205 that is interconnected between the pump 201 and the reservoir 220 to control the amount of flow, and thereby control the suction generated in the return line 203 upstream of a check valve 207 that is normally closed when the pump is inactive. The use of a flow restrictor in a return line is particularly important when a single pump 201 may be used to prime an array of pens as mentioned below.

In order to prime the tube 256, the valve 60 at the container 58 is opened, and the pump 201 is operated to generate a sufficient pressure differential to draw ink from the container 58 to fill the tube 256. The pump is operated for a time sufficient to prime the tube 256. In a preferred embodiment, the pump is carried on the carriage and any excess ink leaving the pump outlet 209 upon completion of the priming operation is directed to a container 211 filled with absorbent material for absorbing that ink.

Figure 9:
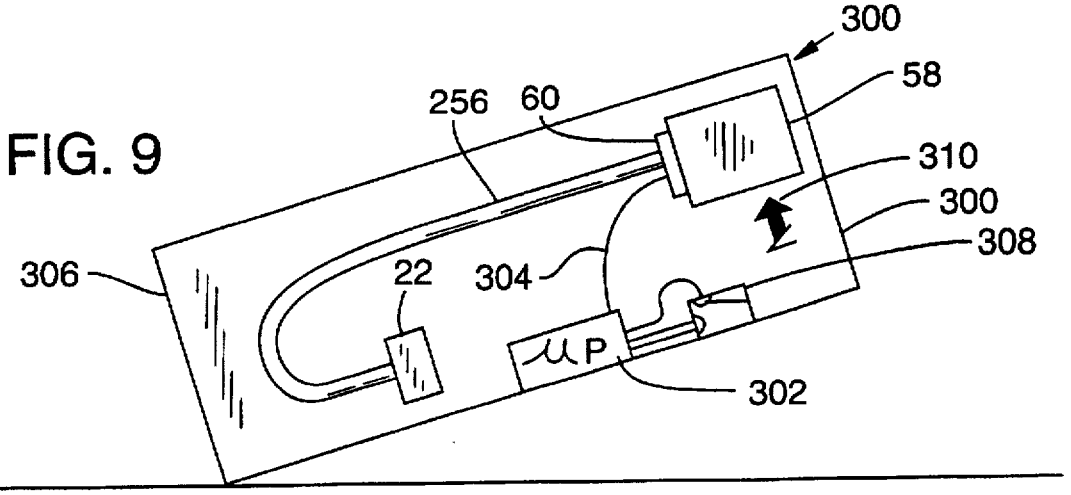
FIG. 9 is a diagram of another technique for priming the supply tube.

FIG. 9 depicts another technique for priming the supply tube 256, wherein the pressure differential for filling the supply tube 256 is generated by manually tipping the printer to elevate the container 58 above the pen reservoir 22. Although this priming technique is described in conjunction with the embodiment of FIG. 3, it will be appreciated that the technique is applicable to all described embodiments.

The technique depicted in FIG. 9 requires the user to tip the ink-jet printer 300 (in which the overall ink supply system is incorporated) by an angle sufficient to raise the ink supply container 58 above the pen reservoir 22 so that ink will flow through the tube 56, thereby priming that tube. The flow volume is regulated by the printer microprocessor 302 that controls via line 304 the electronic valve 60. The microprocessor also monitors a mercury switch 308 that is arranged so that when the printer 300 is tipped from horizontal to the proper orientation (indicia such as shown at 310 may be included in the printer for directing the user) the mercury switch 308 closes, which closing is detected by the microprocessor which thereafter opens the valve 60 for a time sufficient to permit ink to completely fill the tube 56. It may be necessary to tip the printer onto one side 306 in order to generate a sufficient differential for priming the tube 56.

The foregoing has been described in connection with preferred and alternative embodiments. It will be appreciated by one of ordinary skill in the art, however, that various modifications and variations may be substituted for the mechanisms and method described here while remaining defined by the appended claims and their equivalents. For example, the aspects of the invention described herein are readily adaptable to systems that employ an array of pens, each pen carrying a different color such as cyan, magenta, yellow, and black.

The invention claimed is:

1. A method for delivering ink to a pen reservoir that is carried on a reciprocating carriage of a printer, wherein the reservoir is connected by a tube to be in fluid communication with an ink supply that is remote from the reservoir, the method comprising the steps of:

accelerating the reservoir and a portion of the tube adjacent to the reservoir thereby to generate inertial flow of ink through the tube;

wherein the accelerating step includes alternately accelerating the reservoir in opposing directions along a path of motion thereby to generate inertial flow of ink within the tube alternately toward and away from the reservoir;

directing the inertial flow of ink in the tube toward the reservoir; and providing a valve between the tube and the reservoir which can be operated between an open position which allows the flow of ink and a closed position;

moving the valve to the closed position, thereby occluding the tube to retain an amount of the inertial flow of ink in the reservoir as the reservoir moves substantially along an entire path of motion when the inertial flow of ink is away from the reservoir.

2. The method of claim 1 including the step of monitoring the amount of ink within the reservoir.

3. The method of claim 1 wherein the carriage is reciprocated across a distance having a first length during a printing operation, and further including the step of restricting to a fixed second length the distance across which the carriage is reciprocated during the time inertial ink flow enters the reservoir.

4. The method of claim 1 including the step of providing foam within the reservoir for storing the ink.

5. The method of claim 1 wherein the pen reservoir is accelerated in opposing directions along a path of motion at a given rate of acceleration, the given rate of acceleration being greater in one opposing direction than in another.

6. A method for delivering ink to a pen reservoir that is carried on a reciprocating carriage of a printer, wherein the reservoir is connected by a tube to be in fluid communication with an ink supply that is remote from the reservoir the method comprising the steps of:

accelerating the reservoir and a portion of the tube adjacent to the reservoir thereby to generate inertial flow of ink through the tube;

directing the inertial flow of ink in the tube toward the reservoir;

selectively occluding the tube to deliver an amount of the inertial flow of ink to the reservoir;

wherein the accelerating step includes alternately accelerating the reservoir in opposing directions thereby to generate inertial flow of the ink within the tube alternately toward and away from the reservoir;

selectively conducting ink from the reservoir into the tube when the inertial flow of ink is away from the reservoir; and including the step of providing foam within the reservoir for storing the ink, wherein the foam has a first back pressure level when unsaturated with ink and including the step of restricting the rate with which ink is conducted from the reservoir so that ink within the unsaturated foam will not be conducted from the reservoir.

7. An ink delivery system for a printer, comprising:

a pen reservoir;

an ink container;

a tube connected between the reservoir and the container for conducting ink between the container and the reservoir;

a carriage to which the reservoir is mounted;

drive means for accelerating the reservoir and a segment of the tube adjacent to the reservoir as the carriage moves in a scan between a +x and a −x direction with a change of direction at an end of each scan;

an electrically operated valve connected to the tube which has an open position in which ink can flow from the tube to the reservoir and a closed position which prevents the flow of ink from the reservoir back into the tube, the valve being operable between the open and closed positions for selectively preventing inertial ink flow that occurs as a result of the acceleration of the reservoir and tube segment from the ink reservoir into the tube; and valve control means for selectively opening and closing the electrically operated valve at intervals, the intervals being selected to close the valve just before the pen reservoir is accelerated to change direction from the −x to +x, the valve remaining closed until just before the direction of the pen is changed from +x to −x.

8. The system of claim 7 wherein the tube connects with a first ink-carrying branch connected to the reservoir for conducting the inertial flow of ink into the reservoir and a second ink-carrying branch connected to the reservoir for conducting the inertial flow of ink out of the reservoir.

9. The system of claim 8 including a first valve connected to the first branch for preventing ink flow out of the reservoir through the first branch, and second valve connected to the second branch for preventing ink flow into the reservoir through the second branch.

10. The system of claim 9 including foam disposed within the reservoir for storing ink therein.

11. A method for delivering ink to a pen reservoir that is carried on a reciprocating carriage of a printer, wherein the reservoir is connected by a tube to be in fluid communication with an ink supply that is remote from the reservoir, the method comprising the steps of:

accelerating the reservoir and a portion of the tube adjacent to the reservoir thereby to generate inertial flow of ink through the tube;

directing the inertial flow of ink in the tube toward the reservoir;

selectively occluding the tube to deliver an amount of the inertial flow of ink to the reservoir;

including the step of priming the tube by generating a pressure differential across a length of the tube; and wherein the pressure differential is generated by moving the printer to elevate the ink supply relative to the reservoir.

12. The method of claim 11 including the steps of detecting movement of the printer and valving the tube to permit ink to flow through the tube before accelerating the pen.

13. An ink delivery system for a printer, comprising:

a pen reservoir;

an ink container;

a tube connected between the reservoir and the container for conducting ink between the container and the reservoir;

a carriage to which the reservoir is mounted;

drive means for accelerating the reservoir and a segment of the tube adjacent to the reservoir as the carriage moves in a scan between a +x and a −x direction with a change of direction at an end of each scan;

an electrically operated valve connected to the tube which has an open position in which ink can flow from the tube to the reservoir and a closed position which prevents the flow of ink from the reservoir back into the tube, the valve being operable between the open and closed positions for selectively preventing inertial ink flow that occurs as a result of the acceleration of the reservoir and tube segment from the ink reservoir into the tube;

valve control means providing an electrical signal to the electrically operated valve for selectively opening and closing the electrically operated valve at intervals, the intervals being selected to close the valve just before the pen reservoir is accelerated to change direction from the −x to +x, the valve remaining closed until just before the direction of the pen is changed from +x to −x; and a conductor attached to the valve;

wherein the valve is opened and closed by provision of the signal from the valve control means, the signal being conducted to the valve by the conductor.

* * * * *